US010841994B2

(12) United States Patent
Sinphay

(10) Patent No.: US 10,841,994 B2
(45) Date of Patent: Nov. 17, 2020

(54) LED LIGHTING FIXTURE WITH SELECTABLE COLOR TEMPERATURE

(71) Applicant: Hubbell Incorporated, Shelton, CT (US)

(72) Inventor: Anthony Sinphay, Greenville, SC (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 16/441,629

(22) Filed: Jun. 14, 2019

(65) Prior Publication Data

US 2019/0394851 A1 Dec. 26, 2019

Related U.S. Application Data

(60) Provisional application No. 62/689,433, filed on Jun. 25, 2018.

(51) Int. Cl.

| | |
|---|---|
| ***H05B 33/08*** | (2020.01) |
| ***F21V 23/00*** | (2015.01) |
| ***F21K 9/278*** | (2016.01) |
| ***H05B 45/20*** | (2020.01) |
| *F21Y 115/10* | (2016.01) |

(52) U.S. Cl.

CPC ..... *H05B 45/20* (2020.01); *F21K 9/278* (2016.08); *F21V 23/002* (2013.01); *F21V 23/003* (2013.01); *F21Y 2115/10* (2016.08)

(58) Field of Classification Search

CPC ..... H05B 37/02; F21V 23/003; F21V 23/002; F21K 9/278

See application file for complete search history.

(56) References Cited

U.S. PATENT DOCUMENTS

| | | | |
|---|---|---|---|
| 9,345,095 | B2 | 5/2016 | Yan et al. |
| 2012/0306370 | A1 | 6/2012 | Van De Ven et al. |
| 2014/0042920 | A1 | 2/2014 | Chou |

*Primary Examiner* — Joseph L Williams

(74) *Attorney, Agent, or Firm* — Michael Best & Friedrich, LLP

(57) ABSTRACT

A light emitting diode (LED) lighting fixture is provided. The lighting fixture includes a first LED engine and second LED engine. The first LED engine is configured to emit light corresponding to a first correlated color temperature. The second LED engine is configured to emit light corresponding to a second correlated color temperature that is different than the first correlated color temperature. When the first LED engine is hardwired to a power source, a light output of the lighting fixture corresponds to the first correlated color temperature. When the second LED engine is hardwired to the power source, the light output of the lighting fixture corresponds to the second correlated color temperature.

20 Claims, 10 Drawing Sheets

LED LIGHTING FIXTURE WITH SELECTABLE COLOR TEMPERATURE

PRIORITY CLAIM

The present application claims the benefit of priority of U.S. Provisional App. No. 62/689,433, titled "LED Lighting Fixture," having a filing date of Jun. 25, 2018, which is incorporated by reference herein.

FIELD

The present subject matter relates generally to a light emitting diode (LED) lighting fixture.

BACKGROUND

LED lighting systems can include one or more LED devices that become illuminated as a result of the movement of electrons through a semiconductor material. LED devices are becoming increasingly used in many lighting applications and have been integrated into a variety of products, such as light fixtures, indicator lights, flashlights, and other products. LED lighting systems can provide increased efficiency, life and durability, can produce less heat, and can provide other advantages relative to traditional incandescent and fluorescent lighting systems. Moreover, the efficiency of LED lighting systems has increased such that higher power can be provided at lower cost to the consumer.

LED devices can be associated with various color temperatures and/or different monochromatic colors. The color temperature of an LED device provides a measure of the color of light emitted by the LED device. For instance, the color temperature can refer to the temperature of an ideal black body radiator that radiates light of comparable hue to the LED device. LED devices associated with higher color temperatures can provide a more bluish color while LED devices associated with lower color temperatures can provide a more reddish color.

BRIEF DESCRIPTION

Aspects and advantages of embodiments of the present disclosure will be set forth in part in the following description, or may be learned from the description, or may be learned through practice of the embodiments.

One example aspect of the present disclosure is directed to a LED lighting fixture. The lighting fixture includes a first LED engine and a second LED engine. The first LED engine is configured to emit light corresponding to a first correlated color temperature. The second LED engine is configured to emit light corresponding to a second correlated color temperature that is different than the first correlated color temperature. When the first LED engine is hardwired to a power source, a light output of the LED lighting fixture corresponds to the first correlated color temperature. When the second LED engine is hardwired to the power source, the light output of the LED lighting fixture corresponds to the second correlated color temperature.

Another example aspect of the present disclosure is directed to a LED lighting fixture. The LED lighting fixture includes a first LED engine configured to emit light corresponding to a first correlated color temperature. The first LED engine includes a first LED array and a second LED array. The first LED array is configured to emit light corresponding to a first color temperature. The second LED array is configured to emit light corresponding to a second color temperature that is different than the first color temperature. The LED lighting fixture further includes a second LED engine configured to emit light corresponding to a second correlated color temperature that is different than the first correlated color temperature. The second LED array includes a first LED array and a second LED array. The first LED array of the second LED array is configured to emit light corresponding to a third color temperature that is different than the first color temperature and the second color temperature. The second LED array of the second LED devices is configured to emit light corresponding to a fourth color temperature that is different than the first color temperature, the second color temperature and the third color temperature. When the first LED engine is hardwired to a power source, the light emitted by the first LED array of the first LED engine blends with the light emitted by the second LED array of the first LED engine such that a light output of the lighting fixture corresponds to the first correlated color temperature. Conversely, when the second LED engine is hardwired to the power source, the light emitted by the first LED array of the second LED engine blends with the light emitted by the second LED array of the second LED engine such that a light output of the lighting fixture corresponds to the second correlated color temperature.

These and other features, aspects and advantages of various embodiments will become better understood with reference to the following description and appended claims. The accompanying drawings, which are incorporated in and constitute a part of this specification, illustrate embodiments of the present disclosure and, together with the description, serve to explain the related principles.

BRIEF DESCRIPTION

Detailed discussion of embodiments directed to one of ordinary skill in the art are set forth in the specification, which makes reference to the appended figures, in which.

DETAILED DESCRIPTION

Figure 1:
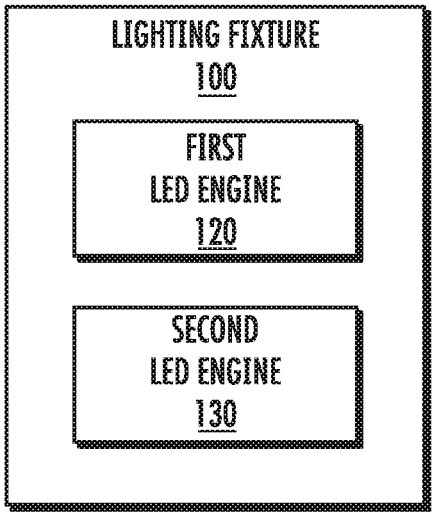
FIG. 1 depicts a block diagram of a LED lighting fixture according to example embodiments of the present disclosure.

Reference now will be made in detail to embodiments, one or more examples of which are illustrated in the drawings. Each example is provided by way of explanation of the embodiments, not limitation of the present disclosure. In fact, it will be apparent to those skilled in the art that various modifications and variations can be made to the embodiments without departing from the scope or spirit of the present disclosure. For instance, features illustrated or described as part of one embodiment can be used with another embodiment to yield a still further embodiment. Thus, it is intended that aspects of the present disclosure cover such modifications and variations.

Example aspects of the present disclosure are directed to a lighting fixture. The lighting fixture can include a first LED engine and a second LED engine. In example embodiments, the lighting fixture can be hardwired to select a particular color temperature output for the lighting fixture. For example, the first LED engine can be hardwired to a power source to provide light at a first correlated color temperature. The second LED engine can be hardwired to the power source to provide light at a second correlated color temperature that is different than the first correlated color temperature. Both the first LED engine and the second LED engine can be hardwired to the power source to provide light at a third correlated color temperature that is different than the first correlated color temperature and the second correlated color temperature.

Aspects of the present disclosure are discussed with reference to LED arrays having different color temperature for purposes of illustration and discussion. The LED arrays can include many other suitable variations without deviating from the scope of the present disclosure. For instance, the LED arrays can be associated with a different brightness, different lighting direction, different layout, or other suitable characteristics. The LED arrays can be implemented on the same circuit board or on different circuit boards.

In example embodiments, the first LED engine can include a first LED array and a second LED array. The first LED array can be configured to emit light at a first color temperature. The second LED array can be configured to emit light at a second color temperature that is different than the first color temperature. When the first LED engine is hardwired to the power source, the light emitted by the first LED array can blend with the light emitted by the second LED array to provide the first correlated color temperature.

In example embodiments, the second LED engine can include a first LED array and a second LED array. The first LED array of the second LED engine can be configured to emit light at a third color temperature. The second LED array of the second LED engine can be configured to emit light at a fourth color temperature that is different than the third color temperature. When the second LED engine is hardwired to the power source, the light emitted by the first LED array can blend with the light emitted by the second LED array to provide the second correlated color temperature.

Example embodiments are discussed with reference to LED engines having multiple LED arrays for purpose of illustration and discussion. The LED engine can have a single LED array associated with a single color temperature or other characteristic without deviating from the scope of the present disclosure. For instance, the first LED engine can be associated with an array having a color temperature of 3000K. The second LED engine can be associated with an array having a color temperature of 4000K. Other suitable color temperatures can be used without deviating from the scope of the present disclosure.

The lighting fixture according to the present disclosure provides numerous technical benefits. For instance, the lighting fixture is configurable to provide light at a variety of different correlated color temperatures without requiring a switching device. More specifically, the lighting fixture of the present disclosure can be configured (e.g., wired) to provide light at the first correlated color temperature, the second correlated color temperature, or the third correlated color temperature when the lighting fixture is installed. In this way, a manufacturer can supply a single lighting fixture that is configurable to provide light at multiple different color temperatures without having to stock inventory of the lighting fixture at each color temperature.

Aspects of the present disclosure are discussed with reference to a lighting fixture having two LED engines for purposes of illustration and discussion. Those of ordinary skill in the art, using the disclosures provided herein, will understand than the lighting fixture can have more than two LED engines, each being capable of being hardwired to a power source to select a desired color temperature output of the lighting fixture.

As used herein, a lighting system can include, but is not limited to, one or more of a lighting circuit, one or more luminaires, one or more LED lighting fixtures, one or more lighting units, a plurality of lighting devices arranged in an environment, a combination of any of the foregoing, or other lighting system. The use of the term "about" in conjunction with a numerical value is intended to refer to within 25% of the stated amount.

Referring now to FIG. 1, a block diagram of a lighting fixture 100 is provided according to example embodiments of the present disclosure. As shown, the lighting fixture 100 can include a first LED engine 120 and a second LED engine 130. It should be appreciated, however, that the lighting fixture 100 can include additional LED engines. As will be discussed below in more detail, the first LED engine 120, the second LED engine 130, or both can be hardwired to a power source (e.g., mains power supply) to provide light at various correlated color temperatures.

Figure 2:
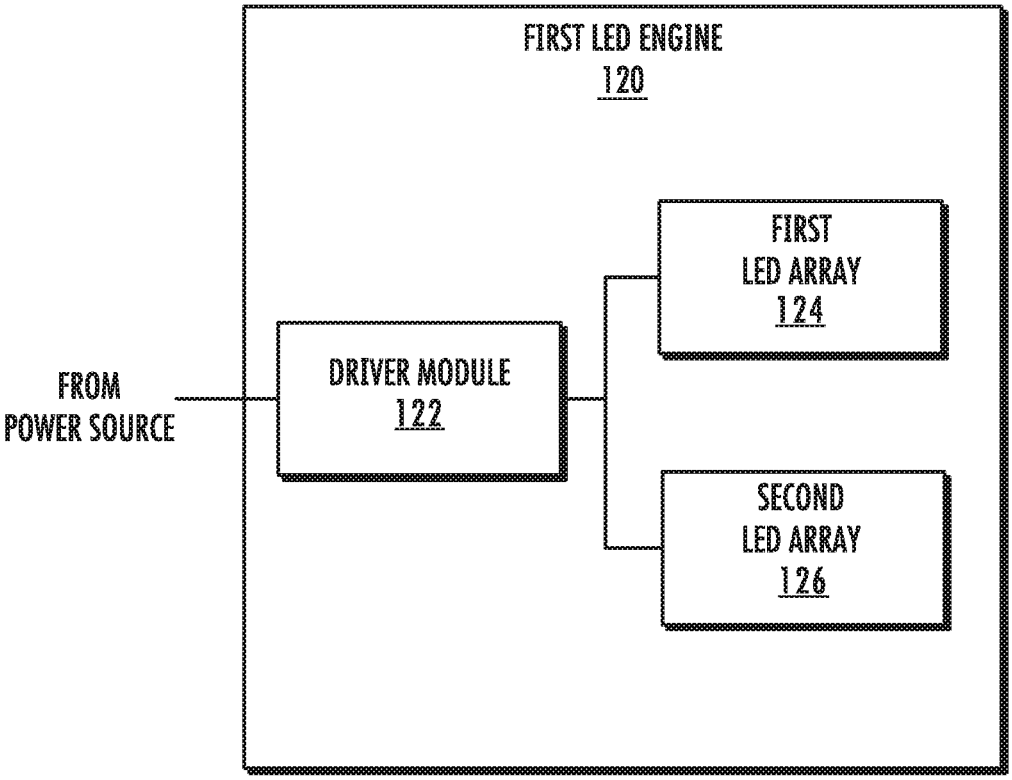
FIG. 2 depicts a block diagram of a first LED engine of the lighting fixture of FIG. 1 according to example embodiments of the present disclosure.

Referring now to FIG. 2, a block diagram of the first LED engine 120 is provided according to example embodiments of the present disclosure. As shown, the first LED engine 120 can include an LED driver circuit 122 and one or more LED arrays. In example embodiments, the first LED engine 120 can include a first LED array 124 and a second LED array 126. While only two LED arrays 124, 126 are illustrated in FIG. 2, those of ordinary skill in the art, using the disclosures provided herein, will understand that the first LED engine 120 can include more or fewer LEDs arrays without deviating from the scope of the present disclosure.

Each of the first LED array 124 and the second LED array 126 can include one or more LED devices. The LED devices can emit light (e.g. visible light, ultraviolet light, infrared light, or other light or electromagnetic energy) as a result of electrons moving through a semiconductor material. In some implementations, the first LED array 124 can be configured to emit light corresponding to a first color, whereas the second LED array 126 can be configured to emit light corresponding to a second color that is different than the first color. Alternatively or additionally, the first LED array 124 can be configured to emit light corresponding to a first color temperature, whereas the second LED array 126 can be configured to emit light corresponding to a second color temperature that is different than the first color temperature.

The present disclosure is discussed with reference to LED arrays having different color or color temperature for purposes of illustration and discussion. The LED arrays can include many other suitable variations without deviating from the scope of the present disclosure. For instance, the LED arrays can be associated with a different brightness, different lighting direction, different layout, or other suitable characteristics. The LED arrays can be implemented on the same circuit board or on different circuit boards.

The LED driver circuit 122 can be configured to receive an input power, such as an input AC power or an input DC power, from a power source and can convert the input power to a suitable driver output (e.g. driver current) for powering the plurality of LED arrays 124. In some embodiments, the LED driver circuit 122 can include various components, such as switching elements (e.g. transistors) that are controlled to provide a suitable driver output. For instance, in one embodiment, the LED driver circuit 122 can include one or more transistors. Gate timing commands can be provided to the one or more transistors to convert the input power to a suitable driver output using pulse width modulation techniques.

In some example embodiments, the LED driver circuit 122 can be a dimmable driver circuit, such as a line dimming driver, such as a phase-cut dimmable driver, Triac dimmer, trailing edge dimmer, or other line dimming driver. The driver output can be adjusted using the line dimming driver by controlling the input power to the dimmable driver circuit.

Figure 3:
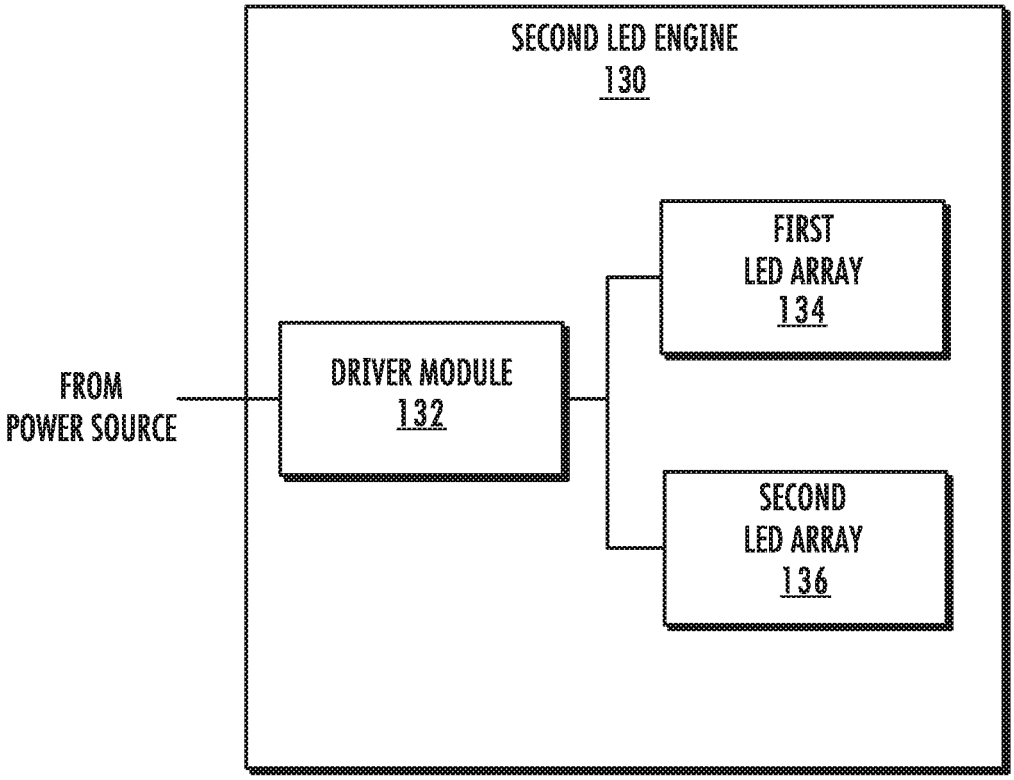
FIG. 3 depicts a block diagram of a second LED engine of the lighting fixture of FIG. 1 according to example embodiments of the present disclosure.

Referring now to FIG. 3, an example embodiment of the second LED engine 130 is provided according to example embodiments of the present disclosure. It should be appreciated that the second LED engine 130 can be configured in substantially the same manner as the first LED engine 120 discussed above with reference to FIG. 2. For instance, the second LED engine 130 includes a LED driver circuit 132 and one or more LED arrays. In example embodiments, the second LED engine 130 can include a first LED array 134 and a second LED array 136. While only two LED arrays 134, 136 are illustrated in FIG. 3, those of ordinary skill in the art, using the disclosures provided herein, will understand that the second LED engine 130 can include more or fewer LEDs arrays without deviating from the scope of the present disclosure.

Each of the first LED array 134 and the second LED array 136 can include one or more LED devices. The LED devices can emit light (e.g. visible light, ultraviolet light, infrared light, or other light or electromagnetic energy) as a result of electrons moving through a semiconductor material. In some implementations, the first LED array 134 can be configured to emit light corresponding to a third color, whereas the second LED array 136 can be configured to emit light corresponding to a fourth color that is different than the third color. It should be appreciated that both the third color and the fourth color are different than the first color and the second color. Alternatively or additionally, the first LED array 134 can be configured to emit light corresponding to a third color temperature, whereas the second LED array 136 can be configured to emit light corresponding to a fourth color temperature that is different than the third color temperature. It should be appreciated that both the third color temperature and the fourth color temperature are different than the first color temperature and the second color temperature.

Figure 4:
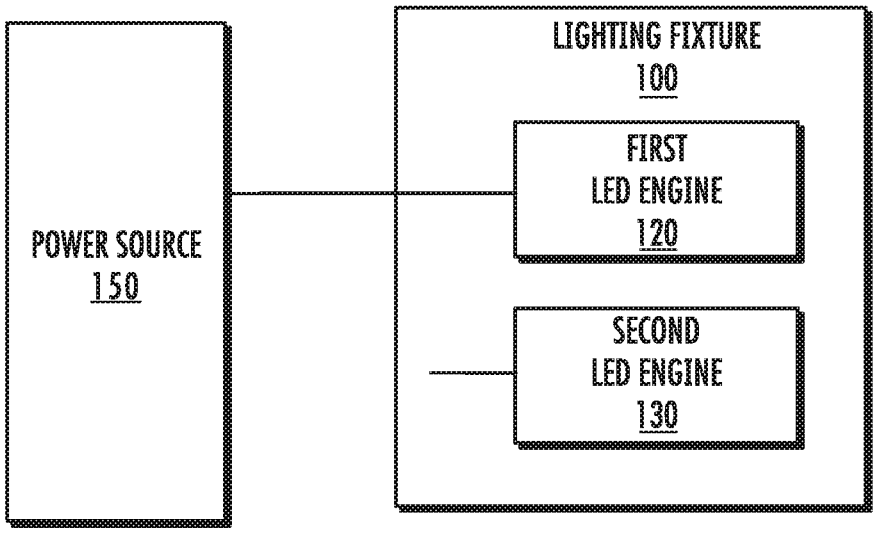
FIG. 4 depicts the first LED engine of FIG. 2 coupled to a power source according to example embodiments of the present disclosure.

Referring now to FIG. 4, the first LED engine 120 of the lighting fixture 100 can be hardwired to a power source 150 (e.g., alternating current (AC) power source, or direct current (DC) power source) such that a light output of the lighting fixture 100 corresponds to a first correlated color temperature. More specifically, a first conductor (e.g., hot conductor) associated with the first LED engine 120 can be coupled to a first conductor (e.g., hot conductor) associated with the power source 150. Additionally, a second conductor (e.g., neutral conductor) associated with the first LED engine 120 can be coupled to a second conductor (e.g., neutral conductor) associated with the power source 150. In this manner, the power source 150 can provide electrical power to the first LED engine 120.

In example embodiments, the first LED array 124 (FIG. 2) can emit light corresponding to the first color temperature when the first LED engine 120 is hardwired to the power source 150. Additionally, the second LED array 126 (FIG. 2) can emit light corresponding to the second color temperature when the first LED engine 120 is hardwired to the power source 150. It should be understood that the second color temperature is different than the first color temperature. The light emitted by the first LED array 124 can blend with light emitted by the second LED array 126 such that the light output of lighting fixture 100 corresponds to the first correlated color temperature. In some embodiments, the first LED engine 120 can have a single LED array configured to emit light corresponding to the first correlated color temperature.

Figure 5:
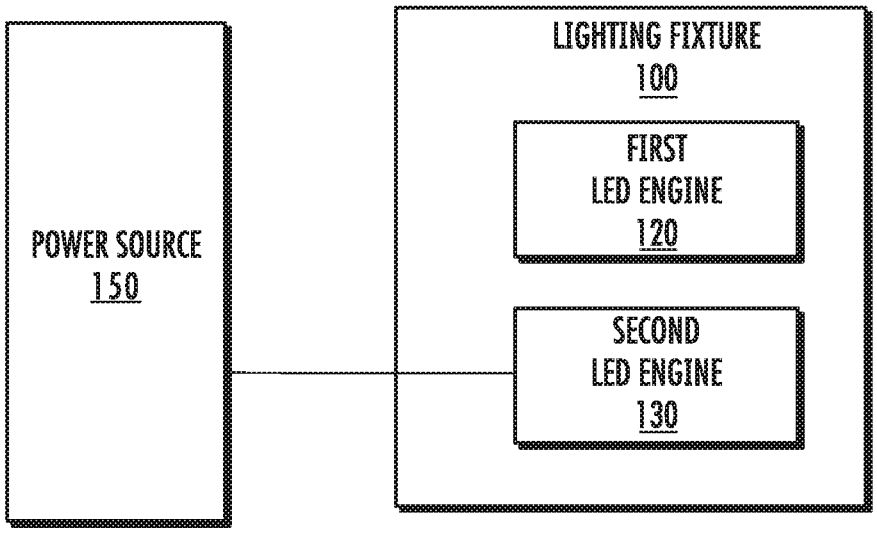
FIG. 5 depicts the second LED engine of FIG. 3 hardwired to a power source according to example embodiments of the present disclosure.

Referring now to FIG. 5, the second LED engine 130 of the lighting fixture 100 can be hardwired to the power source 150 such that the light output of the lighting fixture 100 corresponds to a second correlated color temperature that is different than the first correlated color temperature. More specifically, a first conductor (e.g., hot conductor) associated with the second LED engine 130 can be coupled to a first conductor (e.g., hot conductor) associated with the power source 150. Additionally, a second conductor (e.g., neutral conductor) associated with the second LED engine 130 can be coupled to a second conductor (e.g., neutral conductor) associated with the power source 150. In this manner, the power source 150 can provide electrical power to the second LED engine 130.

When the second LED engine 130 is hardwired to the power source 150, the first LED array 134 (FIG. 3) can, in some implementations, emit light corresponding to a third color temperature that is different than the first color temperature and the second color temperature. Additionally, the second LED array 136 (FIG. 3) can emit light corresponding to a fourth color temperature that is different than the first color temperature, the second color temperature, and the third color temperature. In this manner, the light emitted by the first LED array 134 can blend with light emitted by the second LED array 136 such the light output of the lighting fixture 100 corresponds to the second correlated color temperature. In some embodiments, the second LED engine 130 can have a single LED array configured to emit light corresponding to the second correlated color temperature.

Figure 6:
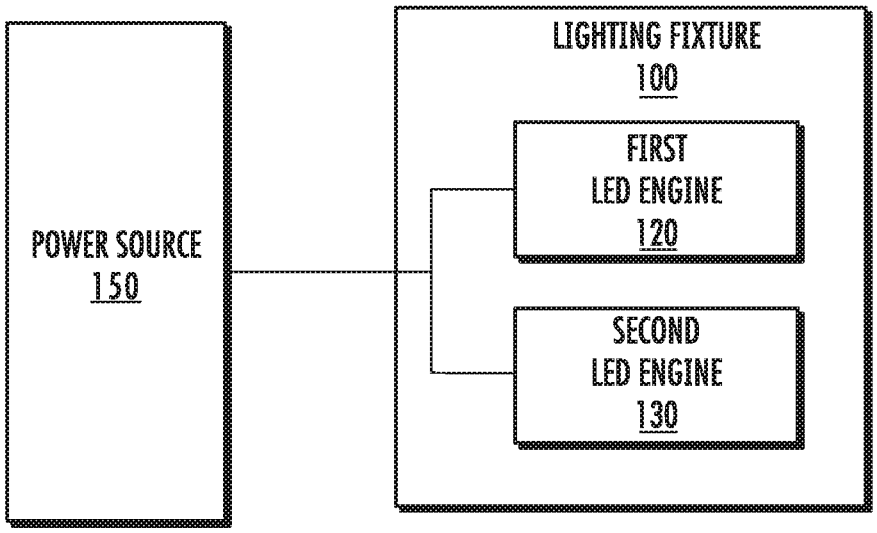
FIG. 6 depicts the first LED engine of FIG. 2 and the second LED engine of FIG. 3 hardwired to a power source according to example embodiments of the present disclosure.

Referring now to FIG. 6, both the first LED engine 120 and the second LED engine 130 can, in some implementations, be hardwired to the power source 150 such that the light output of the lighting fixture 100 corresponds to a third correlated color temperature that is different than the first correlated color temperature and the second correlated color temperature. More specifically, the first conductor (e.g., hot conductor) of both the first LED engine 120 and the second LED engine 130 can be coupled to the first conductor (e.g., hot conductor) of the power source 150. Additionally, the second conductor of both the first LED engine 120 and the second LED engine 130 can be coupled to the second conductor (e.g., neutral conductor) of the power source 150. In this manner, both the first LED engine 120 and the second LED engine 130 can receive electrical power from the power source 150.

When both the first LED engine 120 and the second LED engine 130 receive electrical power from the power source 150, light emitted by the first LED engine 120 blends with light emitted by the second LED engine 130 such that the light output of the lighting fixture 100 corresponds to the third correlated color temperature that is different than the first correlated color temperature and the second correlated color temperature. In this manner, the lighting fixture 100 can be hardwired in the separate configurations (e.g., FIGS. 4, 5, and 6) to provide light output at various correlated color temperatures. A particular lighting output can be selected by the installer upon installation of the lighting fixture 100 and hardwired accordingly.

Figure 7:
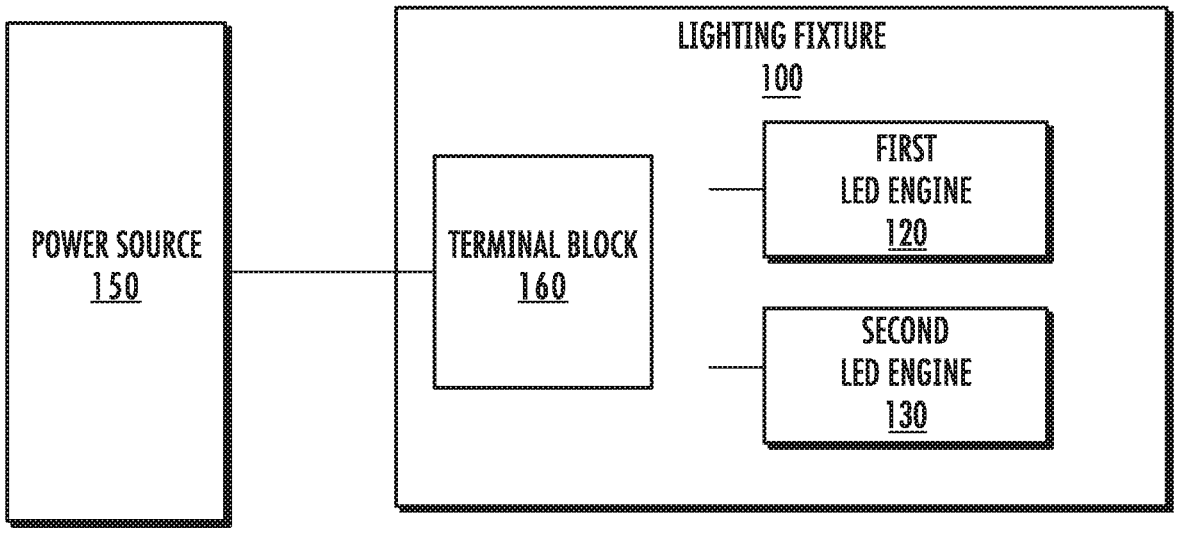
FIG. 7 depicts a block diagram of a lighting fixture according to example embodiments of the present disclosure.

Referring now to FIG. 7, another example embodiment of the lighting fixture 100 is provided according to example embodiments of the present disclosure. It should be appreciated that the lighting fixture 100 of FIG. 7 can be configured in substantially the same manner as the lighting fixture 100 discussed above with reference to FIG. 1. For instance, the lighting fixture 100 of FIG. 7 can include the first LED engine 120 and the second LED engine 130. However, in contrast to the lighting fixture 100 of FIG. 1, the lighting fixture 100 of FIG. 7 includes a terminal block 160. As will be discussed below in more detail, the first LED engine 120, the second LED engine 130, or both can be coupled to the power source 150 via the terminal block 160.

Figure 8:
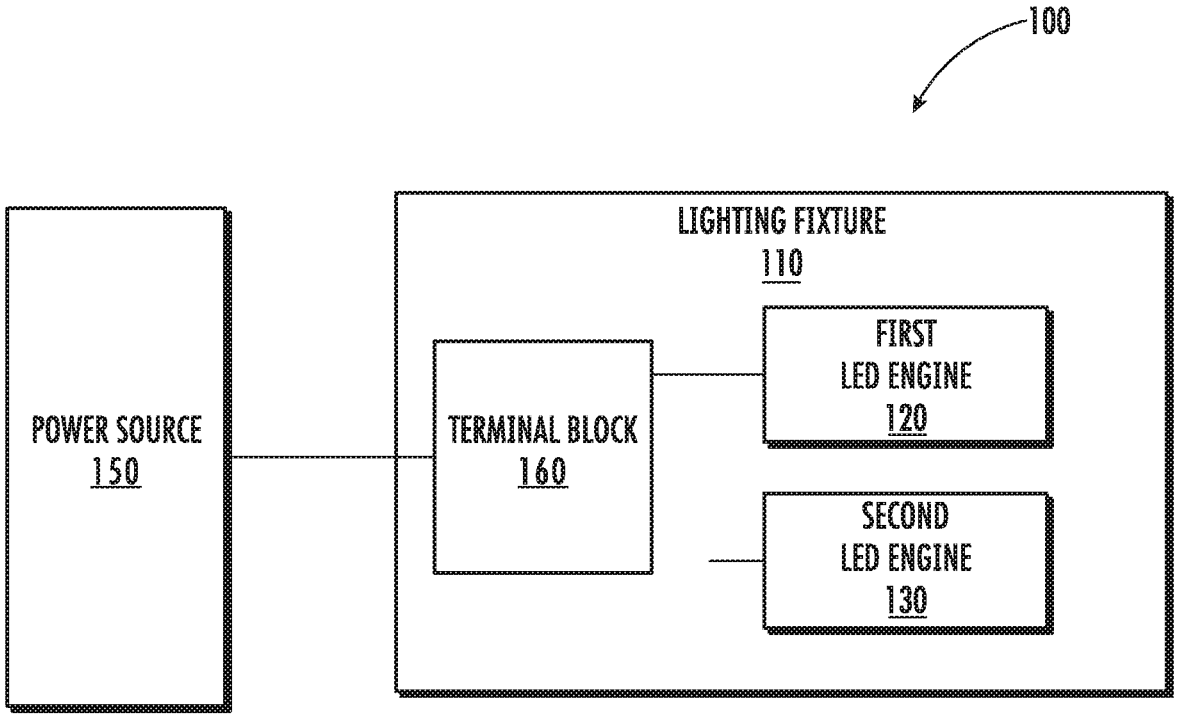
FIG. 8 depicts a first LED engine of the lighting fixture of FIG. 7 hardwired to a power source according to example embodiments of the present disclosure.

Referring now to FIG. 8, one or more conductors (e.g., wires) associated with the power source 150 can be secured or connected to the terminal block 160. More specifically, a first conductor (e.g., hot conductor) associated with the power source 150 and a second conductor (e.g., neutral conductor) associated with the power source 150 can each be secured or connected to the terminal block 160. Additionally, one or more conductors (e.g., wires) associated with the first LED engine 120 can be secured or connected to the terminal block 160. For instance, a first conductor (e.g., hot lead) associated with the first LED engine 120 can be secured or connected to the terminal block 160. Additionally, a second conductor (e.g., neutral) associated with the first LED engine 120 can be secured or connected to the terminal block 160. In this manner, the power source 150 can provide electrical power to the first LED engine 120 via the terminal block 160. When the first LED engine 120 receives electrical power from the power source 150 via the terminal block 160, the light output of the lighting fixture 100 can, as discussed above, correspond to the first correlated color temperature.

Figure 9:
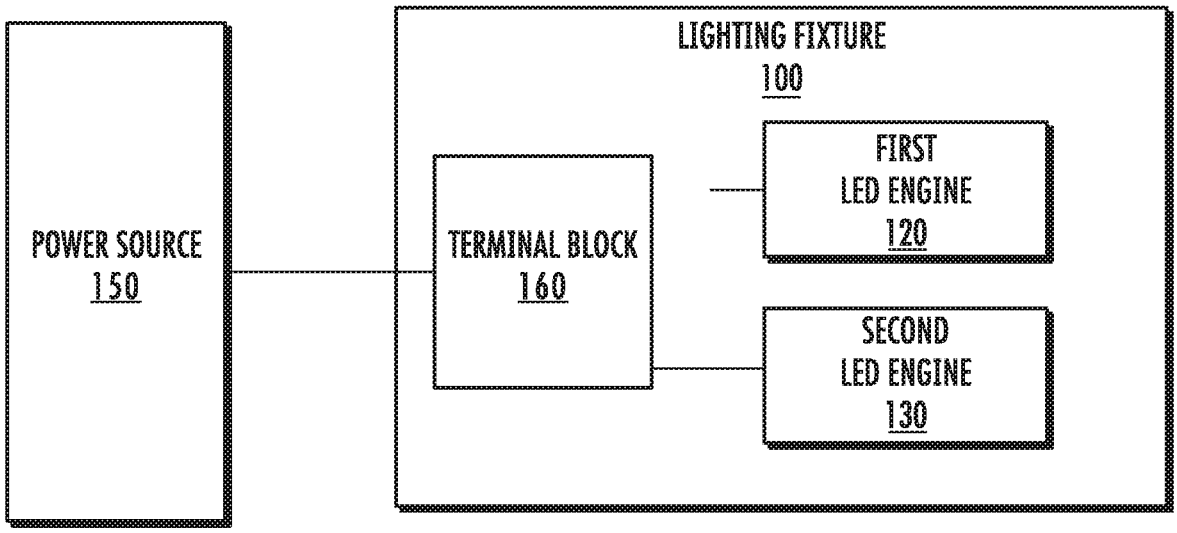
FIG. 9 depicts a second LED engine of the lighting fixture of FIG. 7 hardwired to a power source according to example embodiments of the present disclosure.

Referring now to FIG. 9, one or more conductors (e.g., wires) associated with the second LED engine 130 can be secured or connected to the terminal block 160. In example embodiments, a first conductor (e.g., hot conductor) associated with the second LED engine 130 can be secured or connected to the terminal block 160. Additionally, a second conductor (e.g., neutral conductor) can be secured or connected to the terminal block 160. In this manner, the power source 150 can provide electrical power to the second LED engine 130 via the terminal block 160. When the second LED engine 130 receives electrical power from the power source 150 via the terminal block 160, the light output of the lighting fixture 100 can, as discussed above, correspond to the second correlated color temperature.

Figure 10:
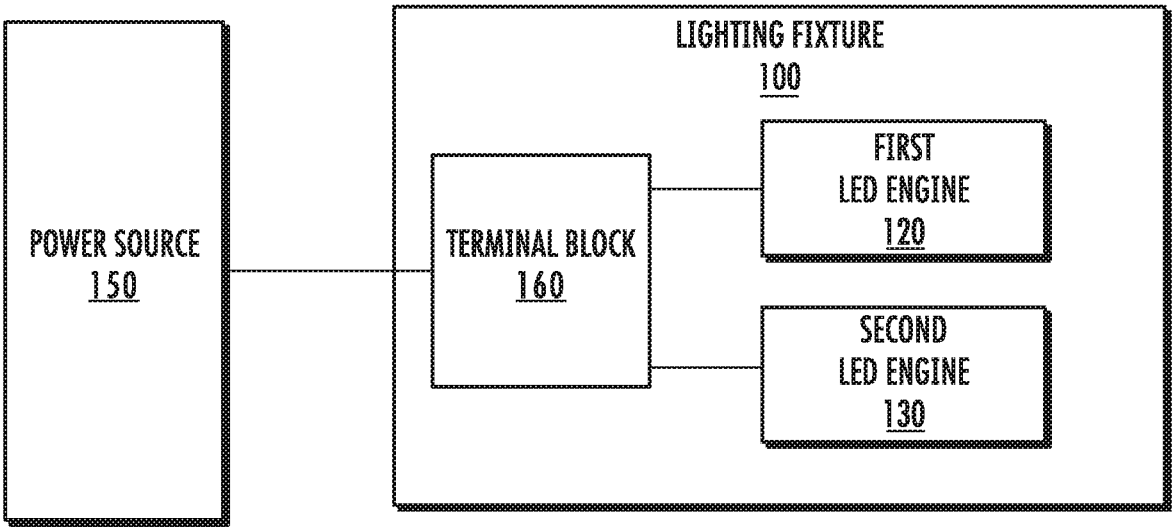
FIG. 10 depicts both the first and second LED engines of the lighting fixture of FIG. 7 hardwired to a power source according to example embodiments of the present disclosure.

Referring now to FIG. 10, one or more conductors (e.g., first conductor and second conductor) associated with the first LED engine 120 can be secured or connected to the terminal block 160. Additionally, one or more conductors (e.g., first conductor and second conductor) associated with the second LED engine 130 can be secured or connected to the terminal block 160. In this manner, both the first LED engine 120 and the second LED engine 130 can receive electrical power from the power source 150 via the terminal block 160.

When both the first LED engine 120 and the second LED engine 130 receive electrical power from the power source 150, the light emitted by the first LED engine 120 blends with the light emitted by the second LED engine 130 such that the light output of the lighting fixture 100 corresponds to the third correlated color temperature that is different than the first correlated color temperature and the second correlated color temperature.

While the present subject matter has been described in detail with respect to specific example embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A light emitting diode (LED) lighting fixture, comprising:

a first LED engine having a first LED array, the first LED engine configured to emit light corresponding to a first correlated color temperature; and a second LED engine having a second LED array, the second LED engine configured to emit light corresponding to a second correlated color temperature that is different than the first correlated color temperature, wherein when the first LED engine is hardwired to a power source, a light output of the lighting fixture corresponds to the first correlated color temperature, wherein when the second LED engine is hardwired to the power source, the light output of the lighting fixture corresponds to the second correlated color temperature, and wherein the first LED engine and the second LED engine are configured to be independently hardwired to the power source.

2. The LED lighting fixture of claim 1, wherein when both the first LED engine and the second LED engine are hardwired to the power source, the light emitted by the first LED engine blends with the light emitted by the second LED engine such that the light output of the lighting fixture corresponds to a third correlated color temperature that is different than the first correlated color temperature and the second correlated color temperature.

3. The LED lighting fixture of claim 1, wherein the first LED engine includes a third LED array, the first LED array configured to emit light corresponding to a first color temperature, the third LED array configured to emit light corresponding to a third color temperature that is different than the first color temperature.

4. The LED lighting fixture of claim 3, wherein when the first LED engine is hardwired to the power source, the light emitted by the first LED array blends with the light emitted by the third LED array such that the light emitted by the first LED engine corresponds to the first correlated color temperature.

5. The LED lighting fixture of claim 3, wherein the second LED engine includes a fourth LED array, the second LED array of the second LED engine configured to emit light corresponding to a third second color temperature that is different than the first color temperature and the third color temperature, the fourth LED array of the second LED engine configured to emit light corresponding to a fourth color temperature that is different than the first color temperature, the second color temperature, and the third color temperature.

6. The LED lighting fixture of claim 5, wherein when the second LED engine is hardwired to the power source, the light emitted by the second LED array of the second LED engine blends with the light emitted by the fourth LED array of the second LED engine such that the light emitted by the second LED engine corresponds to the second correlated color temperature.

7. The LED lighting fixture of claim 1, wherein the power source comprises an alternating current (AC) power source.

8. The LED lighting fixture of claim 1, wherein the power source comprises a direct current (DC) power source.

9. The LED lighting fixture of claim 1, wherein the first LED engine and the second LED engine each comprise a driver circuit.

10. The LED lighting fixture of claim 1, further comprising a terminal block.

11. The LED lighting fixture of claim 10 wherein when the first LED engine is hardwired to the power source, one or more wires associated with the first LED engine are connected to the terminal block and one or more wires associated with the power source are connected to the terminal block.

12. The LED lighting fixture of claim 10, wherein when the second LED engine is hardwired to the power source, one or more conductors associated with the second LED engine are connected to the terminal block and one or more wires associated with the power source are connected to the terminal block.

13. A LED lighting fixture, comprising:

a first LED engine configured to emit light corresponding to a first correlated color temperature, the first LED engine comprising a first LED array and a second LED array, the first LED array configured to emit light corresponding to a first color temperature, the second LED array configured to emit light corresponding to a second color temperature that is different than the first color temperature; and a second LED engine configured to emit light corresponding to a second correlated color temperature that is different than the first correlated color temperature, the second LED array comprising a first LED array and a second LED array, the first LED array of the second LED array configured to emit light corresponding to a third color temperature that is different than the first color temperature and the second color temperature, the second LED array of the second LED engine configured to emit light corresponding to a fourth color temperature that is different than the first color temperature, the second color temperature and the third color temperature, wherein when the first LED engine is hardwired to a power source, the light emitted by the first LED array of the first LED engine blends with the light emitted by the second LED array of the first LED engine such that a light output of the LED lighting fixture corresponds to the first correlated color temperature, wherein when the second LED engine is hardwired to the power source, the light emitted by the first LED array of the second LED engine blends with the light emitted by the second LED array of the second LED engine such that a light output of the LED lighting fixture corresponds to the second correlated color temperature.

14. The LED lighting fixture of claim 13, wherein when both the first LED engine and the second LED engine are hardwired to the power source, the light emitted by the first LED engine blends with the light emitted by the second LED engine such that the light output of the LED lighting fixture corresponds to a third correlated color temperature that is different than the first correlated color temperature and the second correlated color temperature.

15. The LED lighting fixture of claim 13, further comprising a terminal block.

16. The LED lighting fixture of claim 15 wherein when the first LED engine is hardwired to the power source, one or more wires associated with the first LED engine are connected to the terminal block and one or more wires associated with the power source are connected to the terminal block.

17. The LED lighting fixture of claim 15, wherein when the second LED engine is hardwired to the power source, one or more conductors associated with the second LED engine are connected to the terminal block and one or more wires associated with the power source are connected to the terminal block.

18. The LED lighting fixture of claim 13, wherein the first LED engine and the second LED engine are configured to be independently hardwired to the power source.

19. The LED lighting fixture of claim 13, wherein the first LED engine and the second LED engine each comprise a driver circuit.

20. The LED lighting fixture of claim 13, wherein the power source comprises an alternating current (AC) power source.

* * * * *